US008376194B2

(12) United States Patent
Jacuk

(10) Patent No.: US 8,376,194 B2
(45) Date of Patent: Feb. 19, 2013

(54) FLUID OR POWDERY PRODUCT DISPENSER

(75) Inventor: Christophe Jacuk, Le Vaudreil (FR)

(73) Assignee: Aptar France SAS, Le Neubourg (FR)

( * ) Notice: Subject to any disclaimer, the term of this patent is extended or adjusted under 35 U.S.C. 154(b) by 1023 days.

(21) Appl. No.: 11/631,035

(22) PCT Filed: Jun. 30, 2005

(86) PCT No.: PCT/FR2005/050528

§ 371 (c)(1),
(2), (4) Date: Dec. 28, 2006

(87) PCT Pub. No.: WO2006/013304

PCT Pub. Date: Feb. 9, 2006

(65) Prior Publication Data

US 2009/0188949 A1 Jul. 30, 2009

(30) Foreign Application Priority Data

Jul. 1, 2004 (FR) ..... 04 07315

(51) Int. Cl.
*B65D 83/00* (2006.01)

(52) U.S. Cl. ..... 222/402.2; 222/394; 222/402.1

(58) Field of Classification Search ..... 222/402.2, 222/402.1, 394
See application file for complete search history.

(56) References Cited

U.S. PATENT DOCUMENTS 4,475,654 A * 10/1984 Fruchter ..... 206/538
4,819,837 A 4/1989 Goforth
5,372,267 A * 12/1994 Hofmann ..... 215/220
6,149,892 A 11/2000 Britto
6,978,915 B1 * 12/2005 Russell ..... 222/402.2
2004/0056054 A1 3/2004 Ottolangui

FOREIGN PATENT DOCUMENTS

EP 1 304 355 A2 4/2003
WO WO 01/10743 A1 2/2001
WO WO 02/051483 A1 7/2002

OTHER PUBLICATIONS

Plastics materials and processes: A concise encyclopedia; Harper, C. A., & Petrie, E. M. (2003). : Wiley-Interscience. (cover materail, p. 484, 539).*

Conductive Materials for ESD Applications: An Overview, Robert B. Rosner, Compliance Engineering, 2001 Annual Reference Guide, 2001, 18 pages.

* cited by examiner

*Primary Examiner* — Frederick C. Nicolas

(74) *Attorney, Agent, or Firm* — Sughrue Mion, PLLC

(57) ABSTRACT

A powder or liquid dispenser including at least one reservoir that is suitable for containing powder or liquid to be dispensed; a dispenser member, such as a pump or a valve; an actuator member that is suitable for actuating the dispenser member; and a dispenser orifice through which powder or liquid is dispensed. The at least one portion of the dispenser that is in contact with the powder or liquid being made of a non-stick material includes at least one inherently electrostatically dissipative polymer (IDP) that can inherently dissipate electrostatic charge.

5 Claims, 2 Drawing Sheets

A - A

FLUID OR POWDERY PRODUCT DISPENSER

BACKGROUND OF THE INVENTION

1. Field of the Invention

The present invention relates to a dispenser for dispensing a fluid in powder or liquid form.

Advantageous fields of application for such a dispenser are, particularly, but not exclusively, the fields of pharmacy, cosmetics, or perfumery.

2. Description of the Related Art

Some powder or liquid dispensers of the prior art generally include a dispenser member defining a metering chamber that is in communication firstly with one or more powder or liquid reservoirs, and secondly with an actuator member for actuating said dispenser member. The portions of the dispenser for containing the fluid, or for being in contact with the fluid, are usually made of plastics material. Unfortunately, the use of plastics materials very often implies problems with the fluid sticking or adhering to the walls of the portions of the dispenser that are in contact with the fluid, in particular inside the metering chamber. Thus, such adhesion of the fluid to the walls of the metering chamber results in problems of reproducibility in the doses that are dispensed following actuation of the dispenser member.

In order to reduce the extent to which the active principle adheres to the inside of the metering chamber, document WO/02051483 proposes: depositing a fluoride coating on its inside surface by means of "plasma-coating" technology; using fluoro-polymers (such as polytetrafluoroethylene (PTFE)) and other fluro-polymer families (such as polyfluoroalkoxy (PFA), polyvinylidene fluoride (PVDF), . . . ); or else associating fluorine-containing agents with commonly-used materials (resins, polyesters, and acetal) so as to create fluoride compounds.

SUMMARY OF THE INVENTION

An object of the present invention is to overcome the above-mentioned problems, and to propose a solution other than the solutions disclosed in the above-mentioned document.

Another object of the present invention is to provide a powder or liquid dispenser that is simple and inexpensive to manufacture.

Another object of the present invention is to provide a dispenser that makes it possible to dispense fluid in regular and reproducible manner each time the dispenser member is actuated.

The present invention thus provides a powder or liquid dispenser comprising: at least one reservoir that is suitable for containing powder or liquid to be dispensed; a dispenser member, such as a pump or a valve; an actuator member that is suitable for actuating said dispenser member; and a dispenser orifice through which powder or liquid is dispensed; at least one portion of the dispenser that is in contact with the powder or liquid being made of a non-stick material comprising at least one inherently electrostatically dissipative polymer or copolymer (IDP) that can inherently dissipate electrostatic charge. Examples of IDPs are disclosed in particular in document EP 1 304 355. In that document, the IDPs are used in the field of packaging electronic components, and in particular they are used to make hard disk drive components that must remain clean at all times, i.e. without ionic extractables.

However, until the present, IDPs have never been used to solve the problem of powder or liquid adhesion in the field of powder or liquid dispensing.

BRIEF DESCRIPTION OF THE DRAWINGS

The above and/or other features of the present invention will become more apparent and more readily appreciated from the following description of the exemplary embodiments, taken in conjunction with the accompanying drawings of which.

DETAILED DESCRIPTION OF EXEMPLARY EMBODIMENTS

The invention is described more fully below in the following detailed description with reference to the accompanying drawing.

Figure 1:
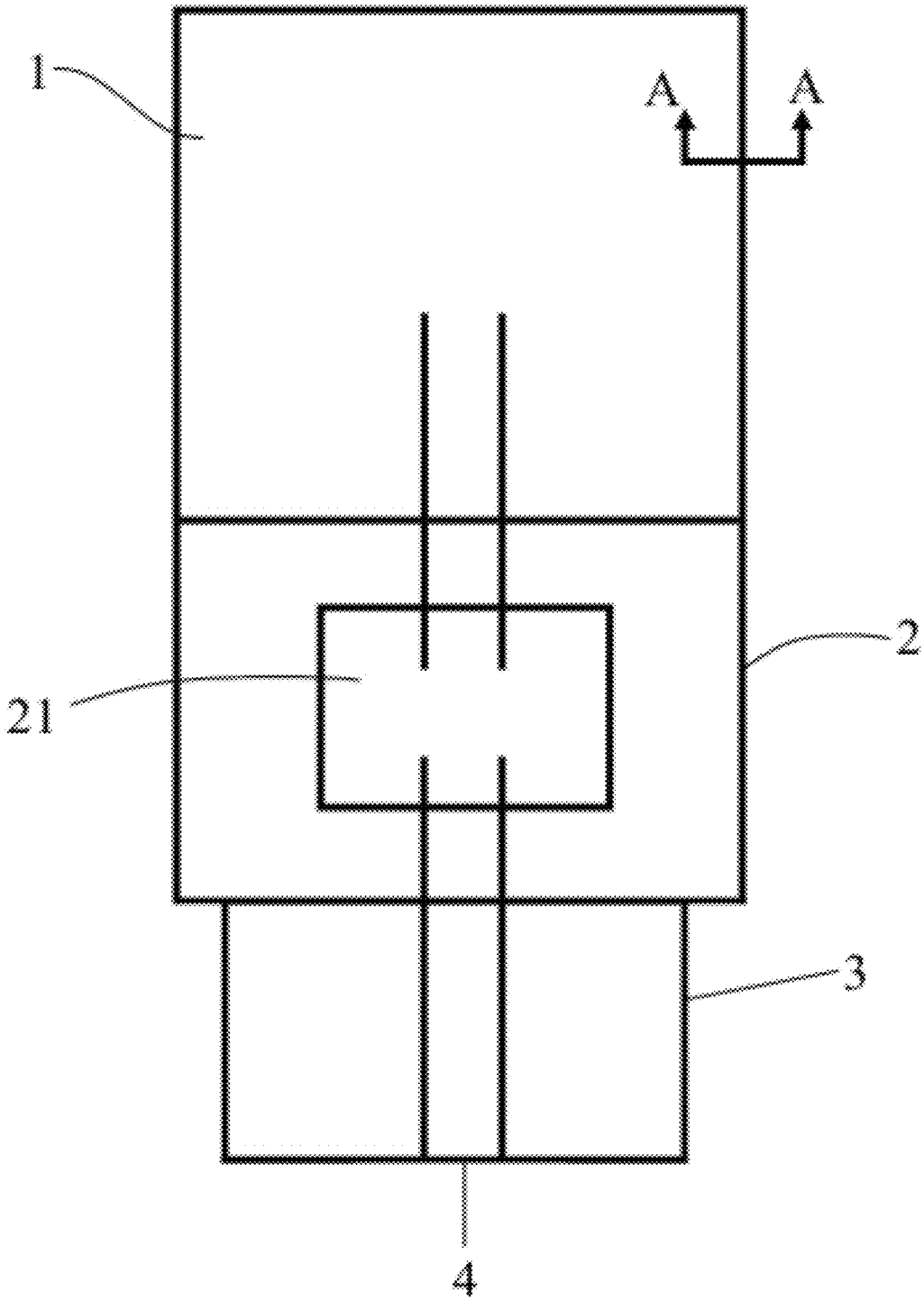
FIG. 1 is a schematic diagram cross sectional view of a dispenser according to an exemplary embodiment of the present invention.

The present invention applies to any type of powder or liquid dispenser. FIG. 1 shows a schematic diagram of a dispenser according to an exemplary embodiment of the present invention. In particular, FIG. 1 shows a high-level schematic diagram of the dispenser in which a general block representation of the elements and their general arrangement are shown in a conceptual manner. Each block of FIG. 1 is not intended to limit the element to a particular size or shape, or to any specific configuration. The dispenser includes a reservoir 1, a dispenser member 2, an actuator member 3 and a dispenser orifice 4. In particular, the present invention can apply to dispensers incorporating a dispenser member 2 such as a pump or a valve. In general, the dispenser member 2, that is actuated by means of an actuator member 3, makes it possible to release, through a dispenser orifice 4, a quantity of fluid contained inside a metering chamber 21 that is in communication with one or more fluid reservoirs 1. The operation of such dispenser members 2 is known, and is therefore not described in greater detail.

The present invention is also particularly suited to dry-powder inhalers in which powder tends to cling to portions that come into contact with said powder, in particular the reservoir(s) and/or the metering chamber and/or the various ducts through which the powder for dispensing is conveyed. For inhalers operating with a valve containing a propellant gas in order to dispense the fluid, the problem of adhesion is increased by the presence of a propellant gas, such as HFA gases (HFA-134a or HFA-227), which provide drive pressure inside the dispenser. This increased pressure tends to force the powder against the walls of the various portions of the dispenser, and thus tends to encourage the powder to adhere to the walls, in particular inside the metering chamber when there is a metering valve. This effect has been made worse as a result of using HFA gases as replacements for CFC gases that are harmful to the environment.

Powder or liquid generally clings or sticks as a result of electrostatic phenomena associated with an imbalance of electric charge between the fluid to be dispensed and the material(s) from which the dispensers are manufactured.

Figure 2:
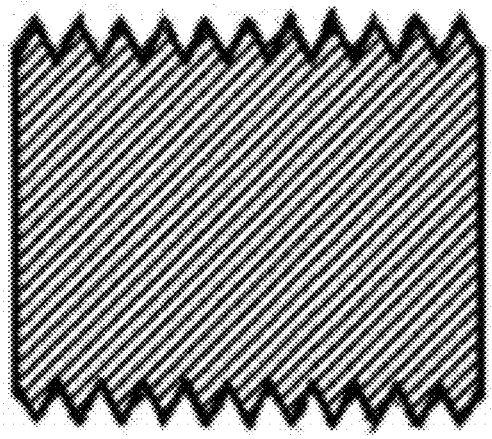
FIG. 2 is a cross-sectional view of line A-A shown in FIG. 1.

As shown in FIG. 2, a portion of the dispenser, advantageously one or more of the elements that come into contact with the powder or liquid, such as the reservoir(s) 1, the metering chamber 21, the dispenser member 2, the actuator member 3, and all of the ducts leading to the dispenser orifice 4, are made of a non-stick material comprising at least one inherently electrostatically dissipative polymer or copolymer, commonly referred to as an IDP, that can inherently dissipate electrostatic charge. The crosshatching shown in FIG. 2 represents an example of at least one part of the dispenser that comes into contact with the powder or liquid, in this case the reservoir 1, made of IDP material. All IDPs come within the present invention. The dissipating properties of IDPs essentially come from their molecular structure. This structure can thus allow ions to flow freely along molecular chains, thereby limiting surface electrostatic charge. By way of non-limiting example, polyetherester, polyetherurethane, polyetheresteramide, and/or polyacrylic acid can be used as an IDP.

In addition, it is also possible to make the portions of the dispenser that come into contact with the fluid from a non-stick material comprising an alloy of at least one IDP and at least one other polymer.

Very often, such alloys have the function of compensating the relatively poor robustness of the IDP. To do this, said at least one polymer combined with the IDP generally presents advantageous mechanical properties. Thus, the alloy obtained has both the non-stick properties of the IDP, and the mechanical properties of said at least one polymer alloyed with the IDP. Such alloys thus make it possible to obtain a polymeric alloy that is stronger, and that is suitable for being injection-molded or extruded without risk of deterioration. In order to form such alloys, said at least one other polymer can be selected from the following polymers: polymethyl methacrylate (PMMA), polybutyl terephthalate (PBT), polyacetal (POM), polyethylene glycol (PETG), polyvinyl chloride (PVC), polyamide (PA), polycarbonate (PC), polystyrene (PS), styrene acrylonitrile (SAN), acrylonitrile butadiene styrene (ABS), high-density polyethylene (HDPE), low-density polyethylene (LDPE), polysulfone (PSU) alloy, polyethylene terephthalate (PET), thermoplastic polyurethane (TPUR) elastomer, polyphenylene sulfide (PPS), polyethersulfone (PES), thermoplastic polyester elastomer (TPE), modified polyphenylene oxide (PPO), polyetherimide (PEI), polyetheretherketone (PEEK), rigid thermoplastic polyurethane (RTPU), saturated styrenic elastomer (SEBS), unsaturated styrenic elastomer (SBS), olefinic thermoplastic elastomer (TEO), vulcanized styrenic elastomer (TPV), polymethylpentene (PMP), perfluoroalkoxy (PFA), ethylene tetrafluoroethylene (ETFE), polyvinylidene fluoride (PVDF), liquid crystal polymer (LCP), fluorinated ethylene propylene (FEP), polyphtalamide (PPA), polyetherketoneketone (PEKK), thermoplastic polyimide (TPI), high-temperature polyamide (NHT), syndiotactic polystyrene (SPS), polytrimethylene terephthalate (PTT). However, this list of polymers should not be considered as being limiting, any polymer that is suitable for being combined with said at least one IDP can be used.

The material of the invention advantageously presents resistivity lying in the range about 1 ohm per square (.OMEGA./sq) to 1012.OMEGA./sq so as to limit fluid adhesion phenomena effectively. This range of particularly small resistivity values thus avoids the non-stick material being charged easily with electrostatic charge, and consequently limits the extent to which the powder or liquid adheres.

Consequently, the present invention proposes an advantageous and effective solution for eliminating the problem of liquid or powder adhesion, in particular inside the metering chamber of a dispenser. The material used thus makes it possible to guarantee that fluid is dispensed more regularly each time the dispenser member is actuated, reducing the variation in the weight of the active principle that is dispensed or inhaled. The invention is thus, particularly, but not exclusively, advantageous specifically for dispensing pharmaceutical formulations.

The invention claimed is:

1. A powder or liquid dispenser comprising:
- at least one reservoir that is suitable for containing powder or liquid to be dispensed;
- a dispenser member;
- an actuator member that is suitable for actuating said dispenser member; and
- a dispenser orifice through which the powder or liquid is dispensed,
- wherein the dispenser member is selected from one of a pump and a valve, and
- at least one portion of the dispenser that is in contact with the powder or liquid is made of a non-stick material comprising at least one inherently electrostatically dissipative polymer or copolymer (IDP) that inherently dissipates electrostatic charge,
- wherein said dispenser member is a metering valve, the dispenser further comprising a HFA gas as a propellant gas for dispensing the powder or liquid, and
- said IDP comprises at least one of a polyetherester, a polyetherurethane, a polyetheresteramide, and a polyacrylic acid.

2. A dispenser according to claim 1 including a metering chamber that is made, at least in part, out of said non-stick material.

3. A powder or liquid dispenser comprising:
- at least one reservoir that is suitable for containing powder or liquid to be dispensed;
- a dispenser member;
- an actuator member that is suitable for actuating said dispenser member; and
- a dispenser orifice through which the powder or liquid is dispensed,
- wherein the dispenser member is selected from one of a pump and a valve, and
- at least one portion of the dispenser that is in contact with the powder or liquid is made of a non-stick material comprising at least one inherently electrostatically dissipative polymer or copolymer (IDP) that inherently dissipates electrostatic charge,
- wherein said dispenser member is a metering valve, the dispenser further comprising a HFA gas as a propellant gas for dispensing the powder or liquid, and
- said non-stick material is an alloy comprising at least one IDP and at least one other polymer.

4. A dispenser according to claim 3, in which said at least one other polymer comprises one of the following polymers: polymethyl methacrylate (PMMA), polybutyl terephthalate (PBT), polyacetal (POM), polyethylene glycol (PETG), polyvinyl chloride (PVC), polyamide (PA), polycarbonate (PC), polystyrene (PS), styrene acrylonitrile (SAN), acrylonitrile butadiene styrene (ABS), high-density polyethylene (HDPE), low-density polyethylene (LDPE), polysulfone (PSU) alloy, polyethylene terephthalate (PET), thermoplastic polyurethane (TPUR) elastomer, polyphenylene sulfide (PPS), polyethersulfone (PES), thermoplastic polyester elastomer (TPE), modified polyphenylene oxide (PPO), polyetherimide (PEI), polyetheretherketone (PEEK), rigid thermoplastic polyurethane (RTPU), saturated styrenic elastomer (SEBS), unsaturated styrenic elastomer (SBS), olefinic thermoplastic elastomer (TEO), vulcanized styrenic elastomer (TPV), polymethylpentene (PMP), perfluoroalkoxy (PFA), ethylene tetrafluoroethylene (ETFE), polyvinylidene fluoride (PVDF), liquid crystal polymer (LCP), fluorinated ethylene propylene (FEP), polyphtalamide (PPA), polyetherketoneketone (PEKK), thermoplastic polyimide (TPI), high-temperature polyamide (NHT), syndiotactic polystyrene (SPS), and polytrimethylene terephthalate (PTT).

5. A powder or liquid dispenser comprising:

at least one reservoir that is suitable for containing powder or liquid to be dispensed;

a dispenser member;

an actuator member that is suitable for actuating said dispenser member; and a dispenser orifice through which the powder or liquid is dispensed, wherein the dispenser member is selected from one of a pump and a valve, and at least one portion of the dispenser that is in contact with the powder or liquid is made of a non-stick material comprising at least one inherently electrostatically dissipative polymer or copolymer (IDP) that inherently dissipates electrostatic charge, wherein said dispenser member is a metering valve, the dispenser further comprising a HFA gas as a propellant gas for dispensing the powder or liquid, and said non-stick material presents resistivity lying in the range about 1 Ω/sq to 1012 Ω/sq.

* * * * *